US006202954B1

(12) United States Patent
Tobin et al.

(10) Patent No.: US 6,202,954 B1
(45) Date of Patent: Mar. 20, 2001

(54) MEDIA TRACKING GUIDE

(75) Inventors: Dwayne Tobin, Longwood; Kenneth Colonel, Oviedo; Christopher Christensen, Orlando, all of FL (US)

(73) Assignee: Datamax Corporation, Orlando, FL (US)

( * ) Notice: Subject to any disclaimer, the term of this patent is extended or adjusted under 35 U.S.C. 154(b) by 0 days.

(21) Appl. No.: 09/294,950

(22) Filed: Apr. 20, 1999

(51) Int. Cl.[7] ..... B41J 15/04; B41J 15/16

(52) U.S. Cl. ..... 242/419; 400/642; 400/619; 400/633; 347/153

(58) Field of Search ..... 242/615.2, 419.4, 242/419.5, 419; 226/17, 19; 400/642, 619, 630, 633; 346/136; 347/104, 153, 262, 264

(56) References Cited

U.S. PATENT DOCUMENTS

| | | | | |
|---|---|---|---|---|
| 1,687,208 | | 10/1928 | Hillard . | |
| 2,402,546 | * | 6/1946 | Gaykowski | 242/615.2 X |
| 2,742,283 | * | 4/1956 | Rivas | 242/615.2 |
| 3,365,142 | * | 1/1968 | Bakke et al. | 242/419.4 |
| 3,971,696 | * | 7/1976 | Manfredi | 242/615.2 X |
| 3,972,460 | | 8/1976 | Kesinger et al. . | |
| 3,973,664 | * | 8/1976 | Wanat | 400/619 |
| 4,326,656 | * | 4/1982 | Gregory et al. | 242/419 X |
| 4,334,770 | * | 6/1982 | Landsman | 347/264 X |
| 4,567,492 | * | 1/1986 | Skafvenstedt et al. | 226/17 X |
| 4,629,177 | | 12/1986 | Roddeman et al. . | |
| 4,797,690 | | 1/1989 | Takita et al. . | |
| 5,186,558 | * | 2/1993 | Sherman et al. . | |
| 5,209,591 | * | 5/1993 | Mizutani et al. | 400/645 |
| 5,244,295 | * | 9/1993 | Terashima et al. | 400/639 |
| 5,564,847 | * | 10/1996 | Patrick et al. | 400/642 |
| 5,673,076 | * | 9/1997 | Nardone et al. . | |
| 6,089,773 | * | 7/2000 | Bailey et al. | 400/642 |

FOREIGN PATENT DOCUMENTS

| | | |
|---|---|---|
| 0015314 | 9/1980 | (EP) . |
| 0080723 | 6/1983 | (EP) . |
| 0368255 | 5/1990 | (EP) . |

* cited by examiner

*Primary Examiner*—Donald P. Walsh
*Assistant Examiner*—Collin A. Webb
(74) *Attorney, Agent, or Firm*—Dilworth & Barrese, LLP

(57) ABSTRACT

The present disclosure is directed to a media tracking guide mechanism for guiding the transport of printing media in a printing apparatus. The media tracking guide mechanism is designed to provide positive tracking to print media of various types passing through the guide as the print media is supplied to a printing apparatus. The print media tracking guide preferably includes a guide housing configured and dimensioned for mounting along a hub portion of a printing apparatus and an armature rotatably coupled to the guide housing. The guide housing includes a core member having a print media transport path along an outer peripheral portion thereof and an overhang support positioned in a spaced relationship from the core member. The overhang support includes a slotted area for receiving a lever component. The core member and overhang support are rigidly coupled to a flange portion along a common side thereof. The armature is coupled by a spring member and is equipped with a head member and associated lever component for selectively biasing the head member against the guide housing. Preferably, the head member includes a roller for providing tracking forces along the print media transport path of the core member. A method of providing positive tracking to print media utilizing the media tracking guide is also disclosed.

10 Claims, 3 Drawing Sheets

MEDIA TRACKING GUIDE

BACKGROUND

1. Technical Field

The present disclosure relates generally to a media tracking guide, and more particularly, relates to a media tracking guide used to guide the transport of printing media in a printing apparatus.

2. Description of the Related Art

In modern printers, a variety of feed and take-up mechanisms are required to be driven and/or wound in order to transport printing media, ribbon, backings, etc. In most applications, these feed and take-up mechanisms require tensioning structure to maintain a desired amount of tension on the transport system and printing media in order to minimize or eliminate roll out or jamming and provide smooth transport of the printing media. One structure used in the art to provide tension is a clutch mechanism. Such a mechanism typically includes a friction plate intended to impart a predetermined torque to the feed and/or take-up mechanisms during operation. See, for example, U.S. Pat. No. 4,797,690. Although adequate for their intended function, these clutch mechanisms are typically expensive, require several assembly and adjustment steps to insure proper operation and cannot be removed or disabled when desired.

Another form of supplying tension to printing media as it is transported across printing mechanisms is seen in U.S. Pat. No. 3,972,460. In that system, fan-fold type printing media is kept at a continuous proper tension by sprocket wheels and pins which are aligned with perforations located along outer edges of the fan-fold printing media. While this system was adequate and inexpensive, it required that the printing media contain perforations which added to the cost of the printing media.

In view of the foregoing drawbacks of previously known printing media guides, it would be desirable to provide a printing media guide which effectively provides a bi-directional tracking force along printing media as it is fed along the transport of a printing apparatus. In addition, a need exists in the art for a simple and versatile media tracking guide which is easily installed and removed from a printing apparatus and configurable for different types and sizes of printing media particularly of the fan-fold type. A need also exists for a media tracking guide which can provide positive tracking forces to printing media which is not dispensed from a media hub within a printing apparatus but preferably, from a source that is outside the printing apparatus such as an independent roller hub or source of fan-fold media.

Accordingly, the present disclosure obviates the disadvantages of the prior art by providing a media tracking guide, which is simple in operation, inexpensive to manufacture, easily installed and removed and capable of providing positive tracking of printing media supplied to a printing apparatus.

SUMMARY

The present disclosure is directed to a media tracking guide mechanism for guiding the transport of printing media in a printing apparatus. The media tracking guide mechanism is designed to provide positive tracking forces to print media of various types passing through the guide as the print media is supplied to a printing apparatus.

Accordingly, a print media tracking guide for providing positive tracking of print media passing through a printing apparatus is disclosed. The print media tracking guide preferably includes a guide housing configured and dimensioned for mounting along a hub portion of a printing apparatus and an armature rotatably coupled to the guide housing. The guide housing includes a core member having a print media transport path along an outer peripheral portion thereof and an overhang support positioned in a spaced relationship from the core member. The overhang support includes a slotted area for receiving the lever component as well as the print media therethrough. The core member and overhang support are rigidly coupled to a flange portion along a common side thereof. The armature is coupled by a spring member and is equipped with a head member and associated lever component for selectively biasing the head member against the guide housing. Preferably, the head member includes a roller for providing tracking forces along the print media transport path of the core member.

In another preferred embodiment, a print media tracking guide for providing positive tracking of print media is disclosed as including a guide housing having a central core member configured and dimensioned for mounting along a hub of a printing apparatus. The guide housing further includes an overhang support wherein the core member and overhang support are in a spaced relationship from one another and define a print media transport path therebetween wherein the print media transport path includes a portion of an outer peripheral portion of the core member. A flange projection is coupled to the core member and overhang support along a common side thereof. An armature is rotatably coupled to the guide housing and includes a roller head member and a lever component for selectively biasing the roller head member against the guide housing. The overhang support further includes a slotted area for receiving the lever component and the print media therethrough.

Preferably, the core member of the print media tracking guide includes ribbed sections and is mounted to the hub of the printing apparatus by frictional forces between the core member and the hub. Also, the bias of the roller head member against the print media transported over the print media transport path of the core member is accomplished by a spring member coupled to both the armature and guide housing.

In addition, the present disclosure discloses a method of providing positive traction to print media. The method includes providing a media tracking guide having a guide housing configured and dimensioned for mounting along a hub of a printing apparatus and an armature rotatably coupled to the guide housing wherein the armature includes a head member selectively positionable against the guide housing. The method further includes mounting the media tracking guide to the hub of the printing apparatus and loading print media through the media tracking guide including insertion of the print media between the head member of the armature and the guide housing.

BRIEF DESCRIPTION OF THE DRAWINGS

The objects and features of the present disclosure, which are believed to be novel, are set forth with particularity in the appended claims. The present disclosure, both as to its organization and manner of operation, together with further objectives and advantages may best be understood by reference to the following description, taken in connection with the accompanying drawings, in which:

DETAILED DESCRIPTION OF PREFERRED EMBODIMENTS

Figure 1:
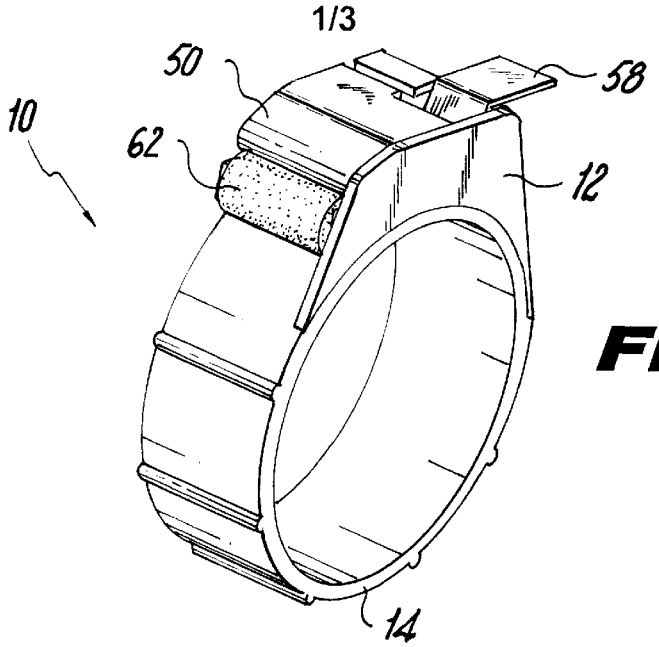
FIG. 1 is a perspective view illustrating the media tracking guide according to the present disclosure.

Reference will now be made in detail to the preferred embodiments of the disclosure, which are illustrated in the accompanying figures. Turning now to the figures, wherein like components are designated by like reference numerals throughout the various figures, attention is first directed to FIGS. 1 and 5.

Figure 5:
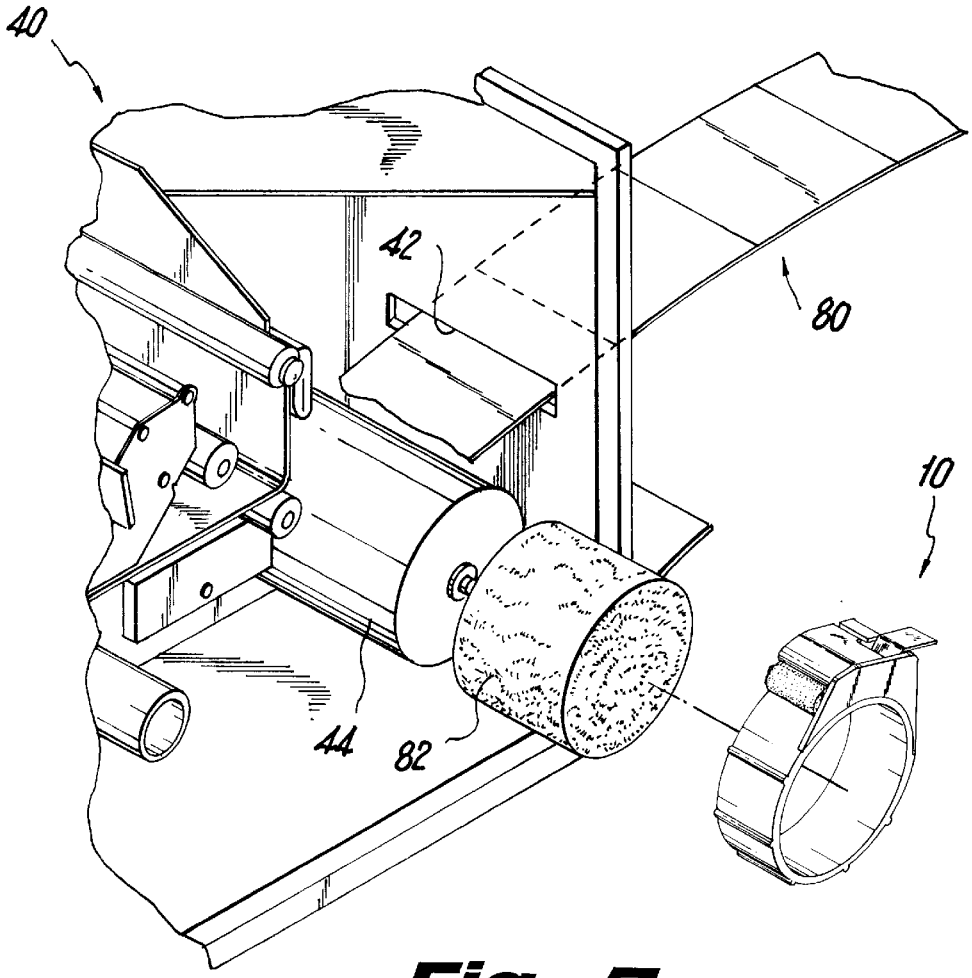
FIG. 5 is an exploded view of the media tracking guide, a printing apparatus and fan-fold type print media according to the present disclosure.

A media tracking guide 10 suitable for providing positive tracking forces of print media such as labels, paper stock and the like is shown at FIG. 1. The present disclosure is preferably suited for print media 80, such as is shown at FIG. 5, and preferably of the type known as "fan-fold" media, that is, having an arrangement which each label (or paper product) is folded along its edge and folded over a preceding label into a deck or stack source. The source of the fan-fold media is preferably situated outside a printing apparatus 40 but may also originate from an area within printing apparatus 40. It is to be understood, however, that the media tracking guide 10 according to the present disclosure finds similar uses with any type of media distribution system including but not limited to fan-fold media distribution, roller hubs and the like both of which can be situated within and/or outside printing apparatus 40.

Figure 2:
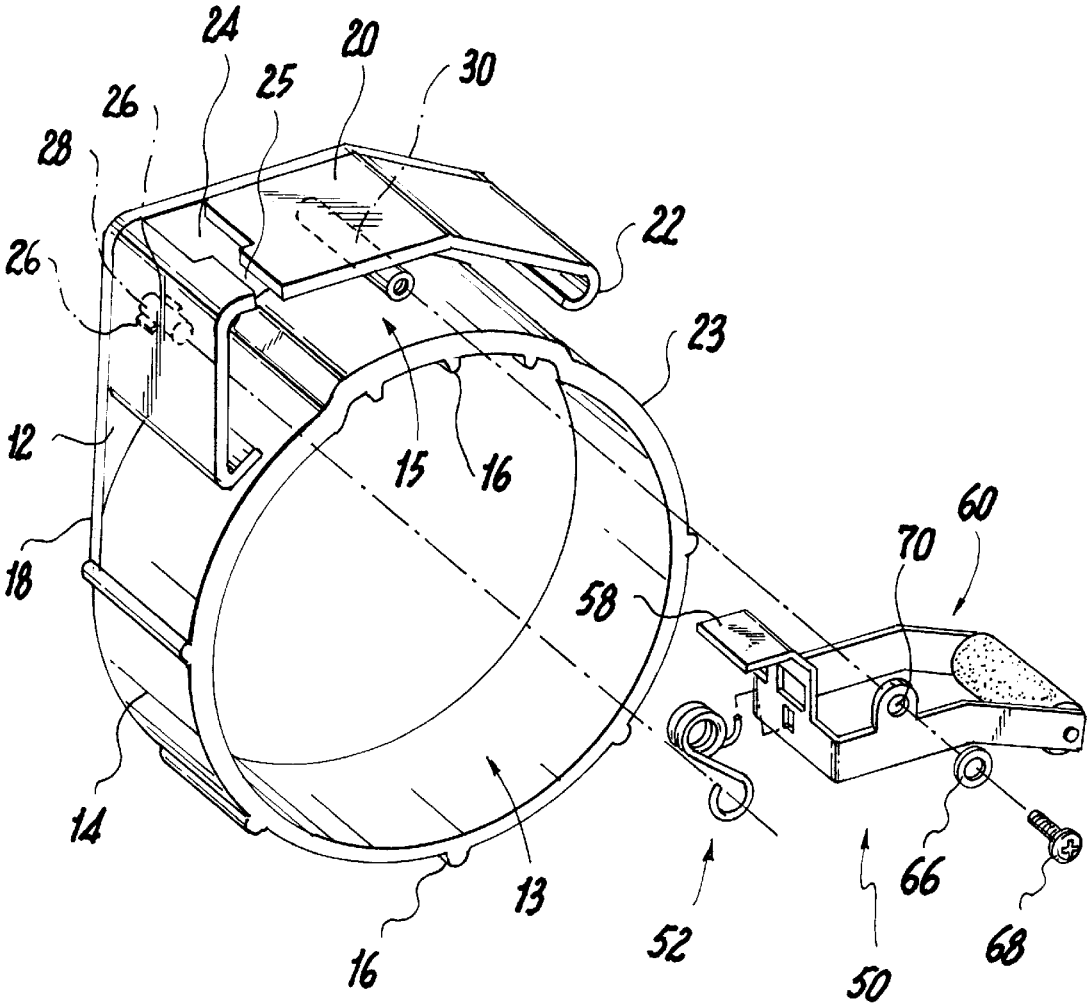
FIG. 2 is a partial exploded view of the media tracking guide of FIG. 1 with the armature and torsion spring offset from the guide housing.
Figure 3:
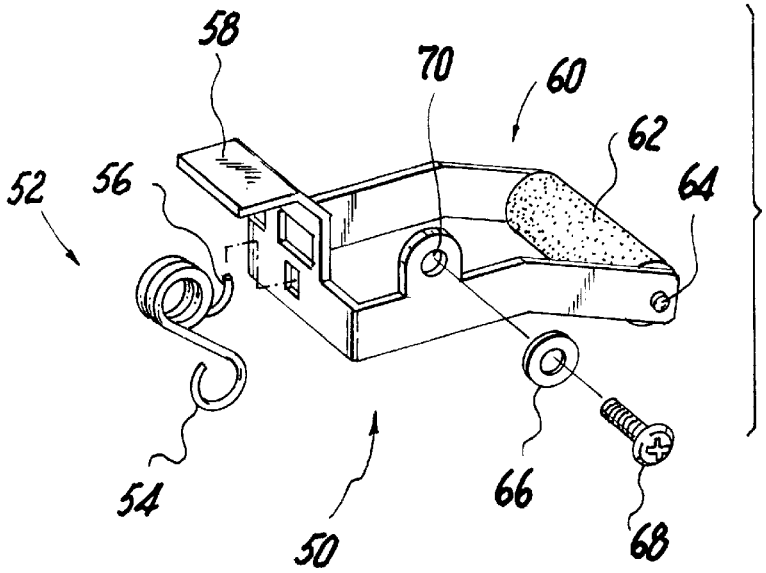
FIG. 3 is a perspective view of the armature and torsion spring of the media tracking guide of FIG. 1.
Figure 4:
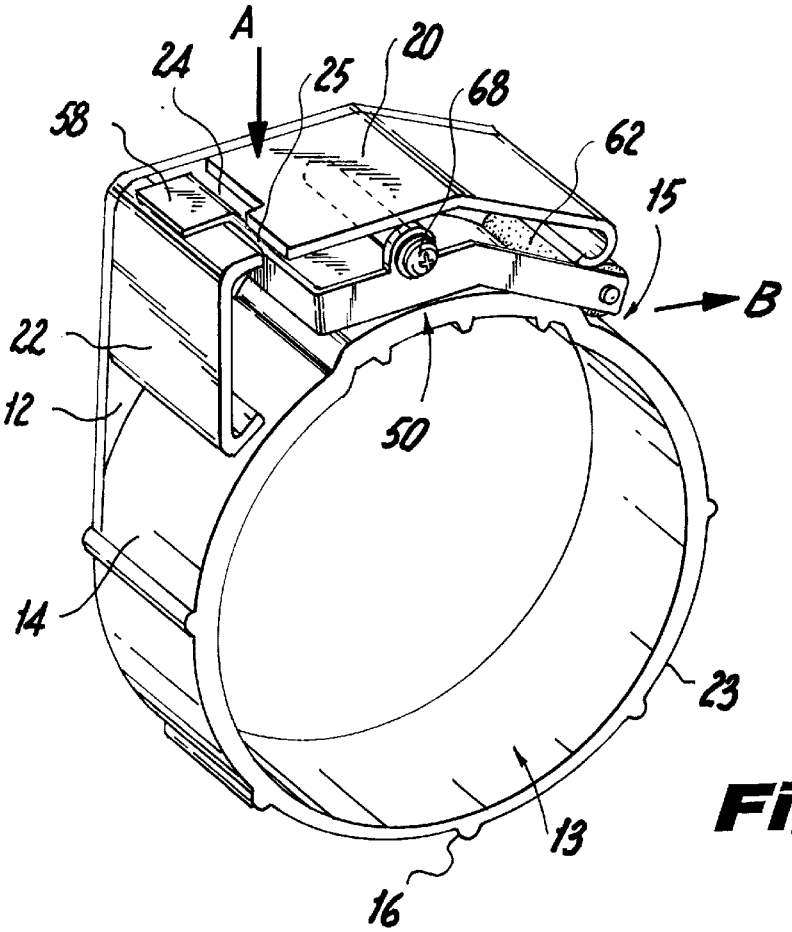
FIG. 4 is a perspective view of the media tracking guide of FIG. 1 indicating print media transport direction.

As is best shown at FIGS. 2–4, media tracking guide 10 includes a guide housing 18 having a cylindrically shaped core member 14 and an overhanging support 20. A flange portion 12 extends over core member 14 and overhanging support 20 along a common side thereof. Core member 14 and overhanging support 20 are spaced apart from each other and define a print media transport path 15 therebetween. The print media transport path 15 further includes an outer peripheral portion of core member 14. A slot area 24 is transversely situated along overhanging support 20 from an open edge 22 to flange portion 12. Print media transport path 15 is designed to receive print media 80 generally in the direction indicated by reference letter "B" (FIG. 4). Core member 14 includes a hollow interior 13 for positioning over a media hub 44, an edge portion 23 and print media transport path 15. Ribs 16 are spaced along an interior and exterior portion of core member 14 and provide added strength as well as a friction fit for media tracking guide 10 when placed over media hub 44 of printing apparatus 40. Flange portion 12 includes post member 28 and fastener receiving member 30 along an inner portion thereof, to be later described herein.

The media tracking guide 10 according to the present disclosure further includes an armature 50 which is fitted under overhanging support 20 and within slot area 24. Armature 50 includes a U-shaped bracket 60 having a roller 62 held by pin 64 along an open end of bracket 60. Bracket 60 includes a roller lever component 58 for actuating armature 50 against outer peripheral portion of core member 14 and print media transport path 15 as printing media 80 is transported therethrough. Armature 50 is rotatably coupled to flange portion 12 by a fastener 68 and fastener receiving member 30. Preferably, fastening of armature 50 to flange portion 12 is accomplished by a screw fastener and washer element 66. Screw fastener 68 is inserted through bore 70 of bracket 60 and is received inside fastener receiving member 30. As it is known in the art, any suitable fastening assembly including but not limited to screws, bolts and nuts, rivets, pins, welding and the like may be used to rotatably couple armature 50 to flange portion 12 of guide housing 18. A torsion spring 52 having a closed loop end 54 and an open hooked end 56 is mounted to post member 28 and armature 50, respectively. Torsion spring 52 provides a biasing force upon armature 50 which results in roller 62 pressing against printing media 80 as it travels along print media transport path 15 and outer peripheral portion of core member 14. By nature of the shape of torsion spring 52 and the partial flange projections 26 along post member 28, the armature 50 can rotate with respect to guide housing 18 along a path having two distinct positions, that is, a roller engaging position and a roller disengaging position.

Roller lever 58 of armature 50 extends out of an enlarged area of slot 24 and along flange portion 12. Roller lever 58 is provided for actuating and positioning armature 50 and roller 62 against print media 80 being transported along print media transport path 15 in the direction generally indicated by reference letter "B" (FIG. 4). Actuation of roller lever 58 in a down direction (toward core member 14) rotates roller 62 upward toward overhanging support 20 and positions armature 50 into its roller disengaging position. As roller lever 58 is actuated downward, roller lever 58 becomes locked in the roller disengaging position and provides an open receiving area between roller 62 and the print media transport path 15 along outer peripheral edge of core member 14. This open receiving area allows access for the loading of print media 80 within media tracking guide 10.

Alternatively, actuation of roller lever 58 in an upward direction (away from core member 14) will rotate roller 62 downward toward core member 14 to its roller engaging position. In this roller engaging position, roller 62 is biased against core member 14 and print media 80 positioned therebetween. In this arrangement, media tracking guide 10 is capable of providing positive tracking to print media types positioned along the print media transport path 15, that is, between roller 62 and the outside peripheral surface of core member 14 in the direction generally indicated by reference letters "A" and "B" (FIG. 4). This positive tracking provides bi-directional forces as well as supplying both tension and direction to the print media 80 being transported through the media tracking guide 10 and into the printing apparatus 40.

With reference to FIG. 5, installation of the media tracking guide 10 will now be discussed in detail. Media tracking guide 10 can be installed in printing apparatuses which utilize roller or cylindrical type media hubs. Typical printing apparatus 40 is shown having media hub 44 and external slot opening 42. External slot opening 42 is provided for the insertion and/or introduction of a source of print media 80. The type of print media 80 initially entering print apparatus 40 may be stacked or rolled either of which may be of the fan-fold type print media. Alternatively, print media 80 may be supplied within the housing of printing apparatus 40 where print media 80 would be in stack or rolled form and be dispensed in an appropriate manner according to the present disclosure.

The media tracking guide 10 is designed to accommodate various media supply hub 44 configurations as well as various print media 80 widths. Installation of the media tracking guide 10 requires the use of an empty media core 82 or other known similarly sized cylindrical objects. The media core 82 is sized to frictionally fit over media hub 44. Media core 82 should have a width less than the width of the printing media 80 to be used. Preferably, the width of the media core 82 should be about 1 inch less than the width of the printing media 80 to be used. Although, other respective width dimensions and parameters for the media core 82 and print media 80 are contemplated and within the scope of the present disclosure. The media core 82 is placed upon media hub 44. Print media 80 is loaded through external slot opening 42 and routed over a top portion of media supply hub 44. As herein previously described, the sources of print media 80 may include rolled or fan-fold type and may be introduced through external slot opening 42 or originate from within the housing of the printing apparatus 40.

As is best shown at FIGS. 1 and 5, roller lever 58 is actuated in a downward direction which rotates roller 62 to its roller disengaging position. The media tracking guide 10 is slid onto media supply hub 44 until an inner portion of flange portion 12 abuts against an outer edge of media core 82. Print media 80 is then routed through print media transport path 15 of core member 14. Once print media 80 is properly positioned within media tracking guide 10, roller lever 58 is actuated in an upward direction which positions roller 62 in its roller engaging position and thereby provides a positive tracking of print media 80 as it passes through the media tracking guide 10. Upon the proper insertion of print media 80 through media tracking guide 10, print media 80 is then routed through printing apparatus 40 in the usual manner and as is known in the art.

It will be understood that various modifications may be made to the embodiments disclosed herein. For example, the media tracking guide 10 may include a plurality of roller mechanisms 62 for providing added bi-directional forces and stability to passing print media 80. Therefore, the above description should not be construed as limiting, but merely as exemplifications of preferred embodiments. Those skilled in the art will envision other modifications within the scope and spirit of the claims appended hereto.

What is claimed is:

1. A print media tracking guide for providing positive tracking of print media passing through a printing media apparatus, the print media tracking guide comprising:

a guide housing, the guide housing being mounted in a printing apparatus, wherein the guide housing includes a core member and an overhanging support in a spaced relationship with one another, the core member and overhanging support being rigidly coupled to a flange portion;

an assembly rotatably coupled to the guide housing, the assembly including a head member selectively biased against the guide housing; and a print media transport path along an outer peripheral portion of the core member.

2. The print media tracking guide according to claim 1, wherein the head member includes a roller.

3. The print media tracking guide according to claim 1, wherein the head member is biased against the guide housing by a spring member.

4. A print media tracking guide for providing positive tracking of print media passing through a printing media apparatus, the print media tracking guide comprising:

a guide housing, the guide housing being mounted in a printing apparatus; and an assembly rotatable coupled to the guide housing, the assembly including a head member selectively biased against the guide housing and a lever component for selectively biasing the head member against the guide housing.

5. The print media tracking guide according to claim 4, wherein the guide housing includes a core member and an overhanging support in a spaced relationship with one another, the core member and overhanging support being rigidly coupled to a flange portion.

6. A print media tracking guide for providing positive tracking of print media, the print media tracking guide comprising:

a guide housing including a central core member configured and dimensioned for mounting along a hub of a printing apparatus, the guide housing further including an overhanging support wherein the core member and an overhanging support are in a spaced relationship with one another and define a print media transport path therebetween, wherein the print media transport path includes an outer peripheral portion of the core member;

a flange projection coupled to the core member and overhanging support; and an assembly rotatable coupled to the guide housing, the assembly including a roller head member and a lever component for selectively biasing the roller head member against the guide housing.

7. The print media tracking guide according to claim 6, wherein the roller head member is biased against the guide housing by a spring member.

8. The print media tracking guide according to claim 6, wherein the overhanging support further includes a slotted area for receiving print media therethrough.

9. A print media tracking guide for providing positive tracking of print media, the print media tracking guide comprising:

a guide housing including a central core member configured and dimensioned for mounting along a hub of a printing apparatus, wherein the core member includes ribs, the guide housing further including an overhanging support wherein the core member and an overhanging support are in a spaced relationship with one another and define a print media transport path therebetween;

a flange projection coupled to the core member and overhang support; and an assembly rotatable coupled to the guide housing, the assembly including a roller head member and a lever component for selectively biasing the roller head member against the guide housing.

10. A print media tracking guide for providing positive tracking of print media, the print media tracking guide comprising:

a guide housing including a central core member configured and dimensioned for mounting along a hub of a printing apparatus, the guide housing further including an overhanging support wherein the core member and an overhanging support are in a spaced relationship with one another and define a print media transport path therebetween, wherein the guide housing is frictionally mounted to the hub of the printing apparatus;

a flange projection coupled to the core member and overhanging support; and an assembly rotatably coupled to the guide housing, the assembly including a roller head member and a lever component for selectively biasing the roller head member against the guide housing.

* * * * *